US010641499B2

(12) United States Patent
Shen et al.

(10) Patent No.: US 10,641,499 B2
(45) Date of Patent: May 5, 2020

(54) PLUG-IN ELECTRIC CERAMIC HEATING PLATE AND ELECTRIC STOVE PROVIDED WITH THE HEATING PLATE

(71) Applicant: Zhejiang Jiu Kang Electric Appliances Co., Ltd., Jiaxing (CN)

(72) Inventors: Chunlei Shen, Jiaxing (CN); Chengnian Wu, Jiaxing (CN)

(73) Assignee: ZHEJIANG JIU KANG ELECTRIC APPLIANCES CO., LTD., Jiaxing, Zhejiang (CN)

( * ) Notice: Subject to any disclaimer, the term of this patent is extended or adjusted under 35 U.S.C. 154(b) by 673 days.

(21) Appl. No.: 15/405,422

(22) Filed: Jan. 13, 2017

(65) Prior Publication Data

US 2018/0087780 A1 Mar. 29, 2018

(30) Foreign Application Priority Data

Sep. 29, 2016 (CN) ..... 2016 1 0864261

(51) Int. Cl.

| | |
|---|---|
| ***F24C 15/10*** | (2006.01) |
| ***F24C 7/06*** | (2006.01) |
| ***F24C 7/08*** | (2006.01) |
| ***H01R 24/68*** | (2011.01) |
| ***H01R 31/06*** | (2006.01) |
| *H01R 103/00* | (2006.01) |

(52) U.S. Cl.

CPC ..... *F24C 15/104* (2013.01); *F24C 7/067* (2013.01); *F24C 7/083* (2013.01); *H01R 24/68* (2013.01); *H01R 31/06* (2013.01); *H01R 2103/00* (2013.01)

(58) Field of Classification Search

CPC .... H01R 31/06; H01R 24/68; H01R 2103/00; F24C 7/067; F24C 15/104; F24C 7/083

USPC ..... 219/459.1

See application file for complete search history.

(56) References Cited

U.S. PATENT DOCUMENTS

| | | | | | |
|---|---|---|---|---|---|
| 3,612,829 | A * | 10/1971 | Evans | F24C 15/108 | 219/452.12 |
| 4,410,793 | A * | 10/1983 | Fischer | F24C 15/102 | 219/448.15 |
| 4,778,978 | A * | 10/1988 | Schreder | H05B 3/748 | 219/447.1 |
| 4,859,833 | A * | 8/1989 | Petersen | A47J 27/004 | 219/432 |
| 6,350,968 | B1 * | 2/2002 | Connolly | G05D 23/1902 | 219/448.11 |

(Continued)

*Primary Examiner* — Eric S Stapleton

(74) *Attorney, Agent, or Firm* — IPro, PLLC

(57) ABSTRACT

A plug-in electric ceramic heating plate and an electric stove provided with the heating plate are disclosed. The plug-in electric ceramic heating plate comprises a plate body and a plate component, and the electric stove provided with the heating plate comprises an electric socket matched with an electric plug on the plug-in electric ceramic heating plate. The plate body includes a plate shell, a temperature controller, a microcrystal glass plate, the electric plug, an electric plug press plate, a plug adapter and a bottom cover plate. The electric plug is connected with the plate component through the plug adapter. The plate has notches formed on its circumference. A convex edge corresponding to the shape of the notch on the circumference of the plate is arranged in the plate shell.

9 Claims, 5 Drawing Sheets

(56) References Cited

U.S. PATENT DOCUMENTS 6,469,282 B1 * 10/2002 Roberts ..... H05B 1/0266 219/451.1
6,492,627 B1 * 12/2002 Ensinger ..... H05B 3/746 219/447.1
6,580,058 B2 * 6/2003 Gratz ..... H05B 3/746 219/448.11
6,949,720 B1 * 9/2005 Munoz ..... F24C 7/06 219/390
8,492,684 B2 * 7/2013 Gutierrez ..... H05B 6/062 219/626
2002/0117497 A1 * 8/2002 Bassill ..... H05B 6/062 219/626
2002/0185489 A1 * 12/2002 Bates ..... H05B 1/0213 219/461.1
2002/0190055 A1 * 12/2002 Perschl ..... F24C 15/10 219/460.1
2002/0190057 A1 * 12/2002 Staebler ..... F24C 7/083 219/506
2003/0029858 A1 * 2/2003 Gratz ..... H05B 3/746 219/448.17
2003/0042246 A1 * 3/2003 Gratz ..... H05B 3/746 219/448.14
2003/0164366 A1 * 9/2003 Baum ..... H05B 3/265 219/467.1
2003/0192873 A1 * 10/2003 Lerner ..... A47J 31/58 219/445.1
2003/0192874 A1 * 10/2003 Lerner ..... A47J 31/58 219/445.1
2003/0222076 A1 * 12/2003 Potthof ..... H05B 3/746 219/490
2004/0072461 A1 * 4/2004 Matsuda ..... H01R 4/48 439/329
2004/0074893 A1 * 4/2004 Wermbter ..... H05B 3/68 219/465.1
2004/0094533 A1 * 5/2004 Gerhardinger ..... H05B 3/68 219/465.1
2004/0099652 A1 * 5/2004 Berkcan ..... H05B 3/746 219/448.11
2005/0184044 A1 * 8/2005 Reiter ..... G01K 15/00 219/448.11
2006/0231546 A1 * 10/2006 Reithofer ..... D06M 15/3562 219/448.19
2007/0045278 A1 * 3/2007 Dittrich ..... H05B 3/746 219/446.1
2007/0084853 A1 * 4/2007 Shingler ..... H05B 3/70 219/452.11
2008/0082217 A1 * 4/2008 Sung ..... F24C 7/082 700/299
2008/0185376 A1 * 8/2008 Gagas ..... H05B 6/1263 219/623
2009/0095169 A1 * 4/2009 York ..... A47J 27/004 99/448
2009/0212038 A1 * 8/2009 Ahlander ..... A47J 27/022 219/429
2010/0108053 A1 * 5/2010 Lee ..... F24C 15/006 126/39 H
2011/0150439 A1 * 6/2011 Fritschie ..... F24C 15/102 392/418
2012/0125912 A1 * 5/2012 Callahan ..... F24C 7/087 219/494
2012/0132647 A1 * 5/2012 Beverly ..... H05B 6/062 219/624
2014/0121787 A1 * 5/2014 Yamazaki ..... H04L 12/2825 700/19
2015/0321946 A1 * 11/2015 Sun ..... C03C 1/002 501/27
2016/0014844 A1 * 1/2016 Schlipf ..... H05B 3/0014 219/544
2016/0174299 A1 * 6/2016 De Los Toyos Lopez ..... F24C 15/102 219/448.17
2016/0227609 A1 * 8/2016 Taplan ..... H05B 3/74

* cited by examiner

PLUG-IN ELECTRIC CERAMIC HEATING PLATE AND ELECTRIC STOVE PROVIDED WITH THE HEATING PLATE

FIELD OF THE INVENTION

The present invention relates to electric stoves, and in particular to a plug-in electric ceramic heating plate and an electric stove provided with the heating plate.

BACKGROUND OF THE INVENTION

In all residential fires in North America, the number of fires caused by cooking ranks first. In a cooking process, if unattended, the temperature of cooking oil in a cooking utensil may exceed the spontaneous combustion point due to continuous heating, and thus the cooking oil generates spontaneous combustion, resulting in fire and/or personnel injuries and property losses.

At present, electric stoves using plug-in coil heating elements in the electric stoves on the market are widely used because users can easily install the heating element by themselves. Thus, the plug-in heating element stoves are convenient to be used. This type of heating plate is generally in a form of "coils" heated by electric heating tubes. These heating plates have a common problem in that they heat up slowly and have poor heat transfer and low heating efficiency. Thus, they hardly meet the requirement of "fast, time saving and energy saving" for consumers. Moreover, those heating plates build up rust on the surfaces if kept in warm and wet environment, and cannot be cleaned easily.

For resistance wire heating electric ceramic heaters, the heating speed and the heating efficiency are significantly higher than those coil heating plates, and the glass-ceramic surface of the ceramic heaters is convenient to clean and never rust. However, the spontaneous combustion problem of the cooking oil is not solved on the ceramic heater, and moreover, the heating plates are installed in the electric stoves by manufacturers, and users cannot remove and install the heating plates by themselves.

For electric stoves provided with plug-in heating plates, the heating plates are installed and removed very conveniently, and the consumers can replace as many as four heating plates within 10 minutes without using a tool. Therefore, it is desirable to have a heating plate that has the heating effect and easy cleaning of the electric ceramic stove, can be interchangeable with the existing plug-in coil heating plate and has a plate surface temperature control function to prevent cooking oil fire. Therefore, it would be very convenient for consumers to upgrade the existing coil element electric stoves to meet the cooking performance demand and meanwhile increase the safety level of kitchens

SUMMARY OF THE INVENTION

In view of the above problems, it is the objective of the present invention to use such a plug-in electric ceramic heating plate that is interchangeable with a heating plate on an existing plug-in coil heating plate electric stove, thus greatly improving the heating speed and efficiency, and making the surface easier to clean. Meanwhile, the plug-in electric ceramic heating plate has the function to help prevent the cooking oil spontaneous combustion. The technical solutions of the present invention are described as follows.

A plug-in electric ceramic heating plate is provided, comprising a plate body and components. components comprise a plate, resistance wires and connecting leads. Specifically:

the plate has notches formed on its circumference, and a temperature controller mounting groove and a connecting lead wiring groove are formed in the peripheral flange of the plate;

the plate body at least comprises a plate shell, a temperature controller, a glass-ceramic disc, an electric plug, an electric plug pressing board, a plug adapter and a bottom cover, and the electric plug connect the plate component through the plug adapter;

the plate shell has a flange on its top with a glass-ceramic disc installed on the top face of the flange; the interior of the plate shell has a convex edge corresponding to the shape of the notch in the circumference of the plate, such that the interior of the plate shell is divided into a temperature controller mounting area and a plate mounting area by the convex edge, the temperature controller mounting groove and the connecting lead wiring groove corresponding to the plate being formed in the convex edge, and a temperature controller mounting boss with a threaded hole being arranged at the bottom of the temperature controller mounting area; the exterior of the plate shell has an electric plug mounting boss arranged at the bottom, an electric plug positioning groove and a plug adapter mounting hole being formed in the mounting boss, the electric plug positioning groove being communicated with the plug adapter mounting hole, the plug adapter mounting hole being communicated with the temperature controller mounting area, the shape of the plug adapter mounting hole being adapted to that of the plug adapter, threaded holes for mounting the electric plug press plate and the bottom cover plate being further formed in the mounting boss, and a plurality of ventilating and cooling holes being formed in the periphery of the mounting boss.

Preferably, a temperature control range of the temperature controller is 245° C.-395° C.

Preferably, the temperature controller mounting boss of the plate shell is columnar, and the temperature controller mounting boss is placed in the plug adapter mounting hole, and the bottom of the temperature controller mounting boss limits the plug adapter, and the plug adapter mounting hole in the bottom of the plate shell is a rectangular hole, and the electric plug positioning groove is an arc-shaped groove, and the size of the connecting lead wiring groove in the convex edge in the plate shell is larger than that of the connecting lead wiring groove in the plate flange; and the notches in the plate are arc-shaped, and the shape of the convex edge in the plate shell is the same as that of the notch in the plate.

In order to ensure the mounting and positioning of the plug-in electric ceramic heating plate on the electric stove, a mounting and positioning groove is formed in the circumference of the outer surface of the plate shell, and the groove goes through to the bottom surface of the top flange; or a plurality of mounting and positioning ribs are arranged on the circumference of the outer surface of the plate shell.

In order to ensure the adhesion quality and the appearance of the glass-ceramic disc at the top of the plate shell, an annular groove is arranged in the glass-ceramic disc mounting surface at the top flange of the plate shell; or an annular convex edge is arranged on the outer ring of the glass-ceramic disc mounting surface.

More specifically, the plate shell is made of an aluminum alloy by die-casting molding, and the plate is made of a refractory, thermal-insulation and insulating composite material by compression molding.

The connecting lead on the plate component includes a lead for connecting the temperature controller and a lead for connecting the plug adapter. The diameter of the lead for connecting the plug adapter should be kept within 1.0-2.0 mm. The connection with the resistance wire and the connection with the temperature controller are achieved by welding structures. The connecting lead introduced to the end of the plug adapter is positioned to be corresponding to a plug adapter hole, and perpendicular to the end face of the plug adapter into which the connecting lead is inserted.

The temperature controller is fixed on the temperature controller mounting boss of the plate shell through a screw. The electric plug is communicated with the connecting lead of the plate component through the plug adapter, and the electric plug is fixed to the plug adapter by screws via the plug press plate and the bottom cover plate. The glass-ceramic disc is fixed on the top face of the plate shell by adhesive bonding.

Depending on whether the electric stove is provided with a positioning and mounting ring, different plate shell structures are selected. If the electric stove is provided with the positioning and mounting ring, the plate shell provided with the mounting and positioning groove on the circumference is selected, otherwise, the plate shell provided with the mounting and positioning ribs on the outer surface is selected.

The present invention further provides an electric stove, comprising the above mentioned plug-in electric ceramic heating plate and an electric stove body. At least an electric socket matched with the electric plug on the plug-in electric ceramic heating plate is provided on the electric stove body.

The present invention has the following beneficial effects:

1. better universality and the interchangeability. The plug-in electric ceramic heating plate can replace a plug-in coil heating element directly and can be removed and installed by consumers conveniently, thereby being beneficial for the consumers to upgrade the electric stove.

2. The heating speed is faster and the efficiency is better. As shown in a heating contrast test of the plug-in electric ceramic heating plate and the plug-in coil electric heating plate, the heating time of the plug-in electric ceramic heating plate is shortened for nearly 40-50%, so that the heating speed is much faster, hence, the plug-in electric ceramic heating plate is more energy-saving, time-saving and faster cooking.

3. A surface temperature limitation control function is provided. The temperature control range of the temperature controller is 245° C.-395° C., and the temperature of the plate surface of the electric ceramic heating plate can be controlled to be lower than 380° C. Therefore, the cooking oil in the cooking utensil will not exceed the spontaneous combustion temperature while at the same time guaranteeing a high enough cooking temperature to satisfactorily cook.

4. The plate of the present invention is made of special refractory, thermal-insulation and insulating composite material by compression molding, so that the thermal efficiency is high, the thermal insulation effect is excellent, and the temperature on the bottom and the periphery of the plug-in electric ceramic heating plate can be lower than 180° C.

5. The plug-in electric ceramic heating plate is innovative, good-looking and easy to clean. The shell of the plug-in electric ceramic heating plate is made of aluminum alloy by die-casting molding, so that the appearance is beautiful, and a plurality of surface coating colors can be selected. The top face of the plate is made of the glass-ceramic disc, thereby being more convenient to clean, and never get rust.

6. The corrosion resistance is much better than that of the existing heating coil plates or hot plates.

7. The power range of the heating plate of the present invention is 800-3500W, so that different consumption demands can be satisfied.

8. Serial products with multiple structures can be formed, so that the market prospect is good.

BRIEF DESCRIPTION OF THE DRAWINGS

The accompanying drawings, which are included to provide a further understanding of the invention and are incorporated in and constitute a part of this specification, illustrate embodiments of the invention and together with the description explaining the principles of the invention.

DETAILED DESCRIPTION OF THE APPLICATION

Reference will now be made in detail to the preferred applications of the present invention, examples of which are illustrated in the accompanying drawings.

Application 1

Figure 1:
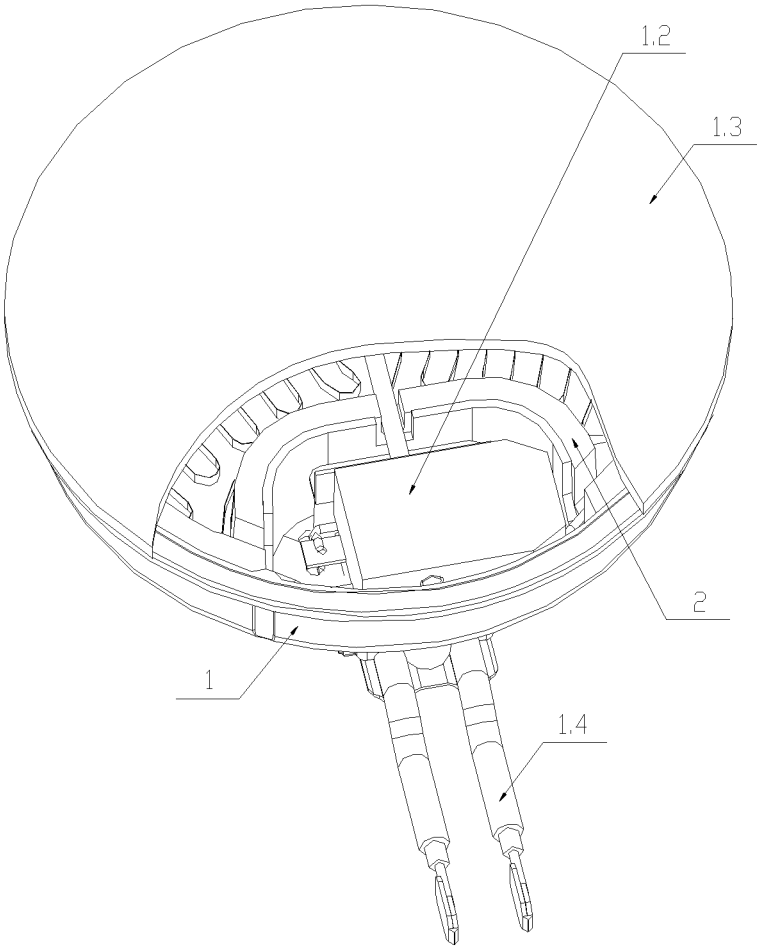
FIG. 1 is a downward inclined plan view of three-dimensional structure of a plug-in electric ceramic heating plate (partially sectional view of a glass-ceramic disc) according to an application of the present invention.
Figure 2:
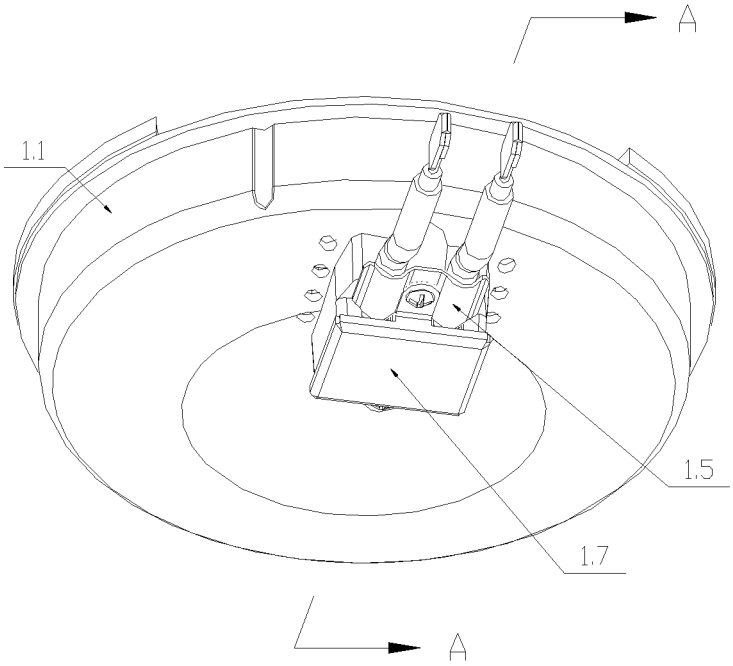
FIG. 2 is an upward inclined plan view of three-dimensional structure of a plug-in electric ceramic heating plate according to an application of the present invention.
Figure 3:
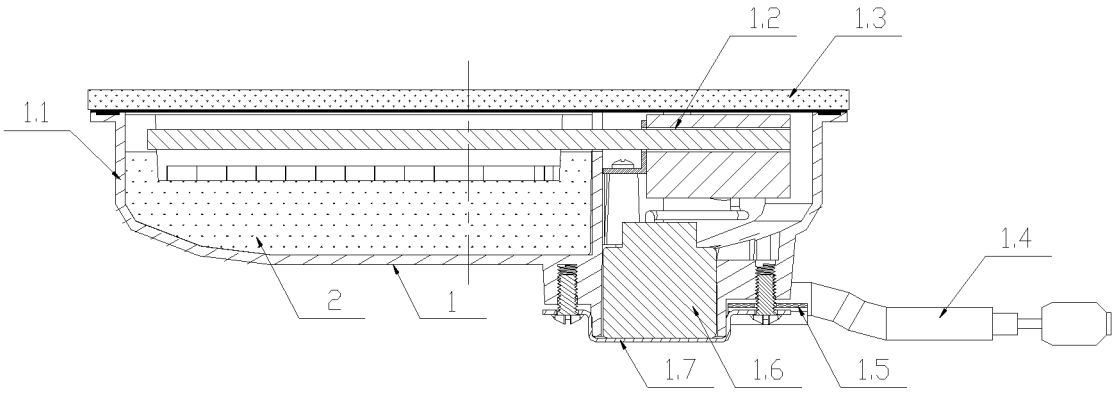
FIG. 3 is a schematic plan view of the A-A direction sectional view of FIG. 2 (full sectional view) according to an application of the present invention.
Figure 4:
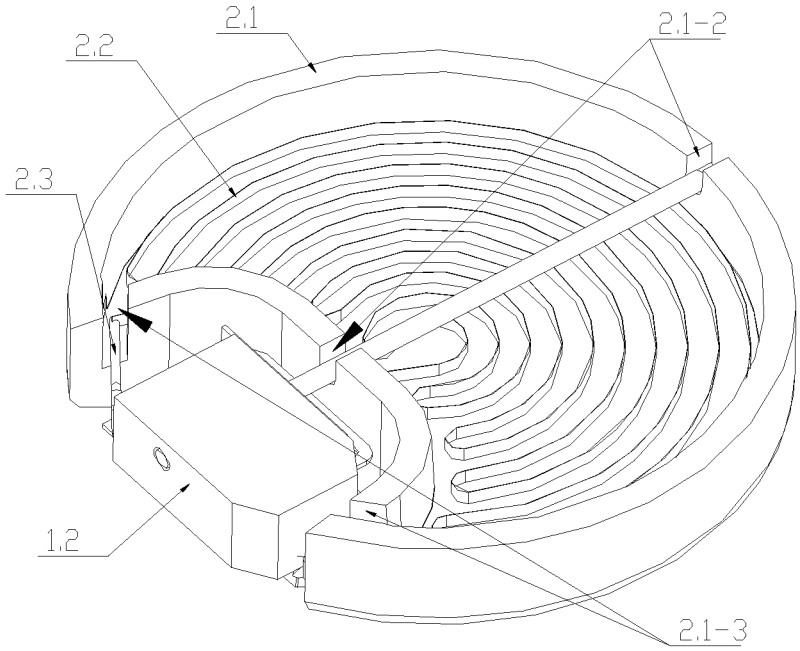
FIG. 4 is a downward inclined plan view of three-dimensional structure of a plate component containing a temperature controller according to an application of the present invention.
Figure 5:
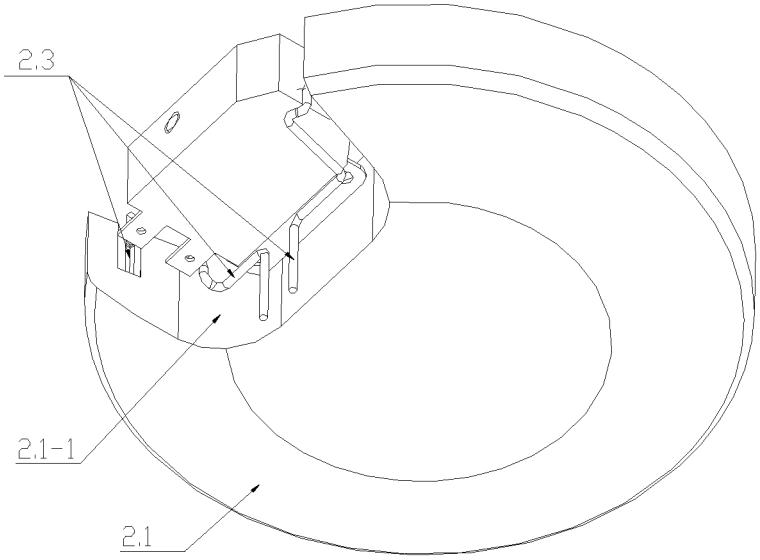
FIG. 5 is an upward inclined plan view of three-dimensional structure of a plate component containing a temperature controller according to an application of the present invention.
Figure 6:
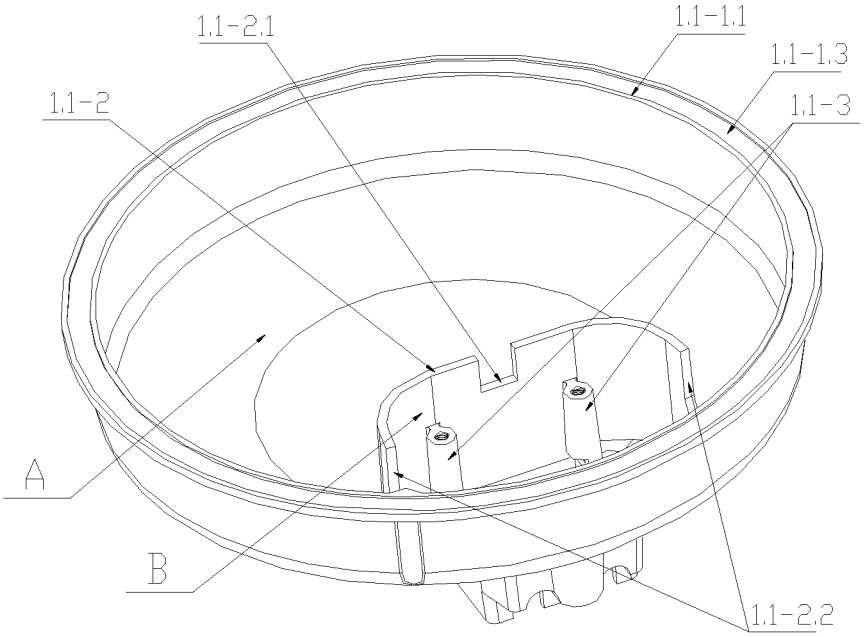
FIG. 6 a downward inclined plan view of three-dimensional structure of a plate shell with a mounting and positioning groove according to an application of the present invention.
Figure 7:
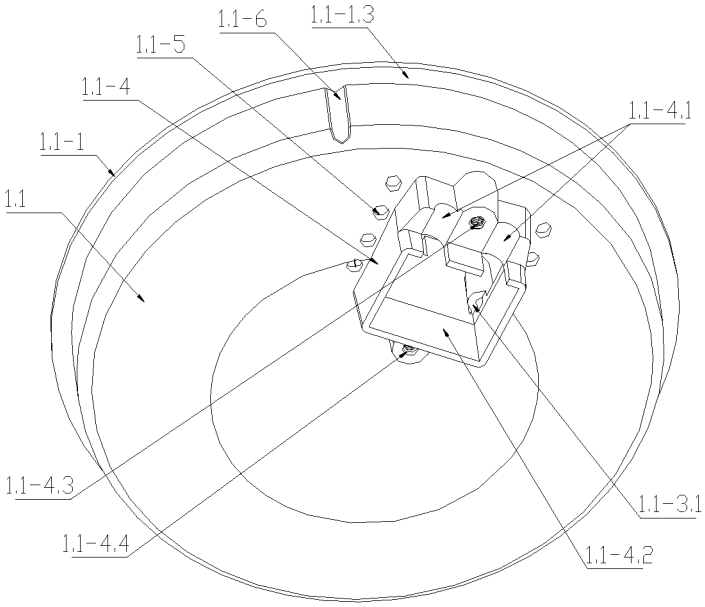
FIG. 7 is an upward inclined plan view of three-dimensional structure of a plate shell with a mounting and positioning groove according to an application of the present invention.
Figure 8:
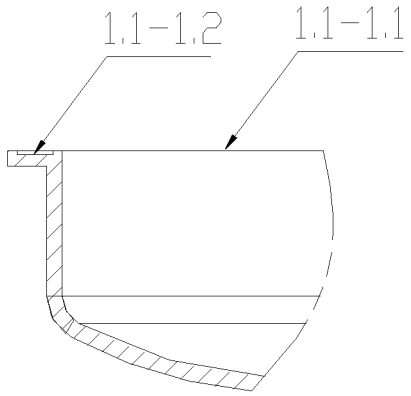
FIG. 8 is a partial schematic view of a planar structure at a flange of a plate shell according to an application of the present invention.
Figure 9:
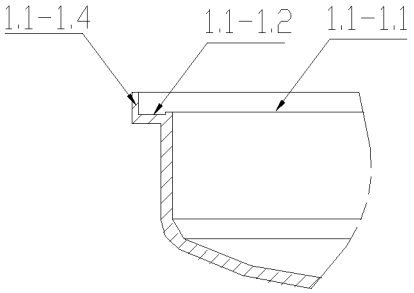
FIG. 9 is a partial schematic view of a planar structure at a flange of a plate shell provided with a convex edge on the outer ring of a glass-ceramic disc mounting surface according to an application of the present invention.
Figure 10:
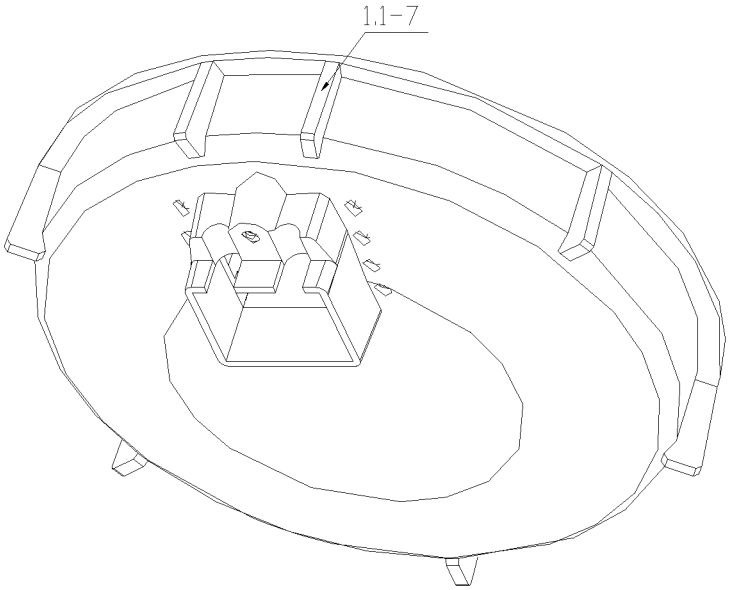
FIG. 10 is an upward inclined plan view of three-dimensional structure of a plate shell with mounting and positioning ribs according to an application of the present invention.

As shown in FIG. 1 to FIG. 10, a plug-in electric ceramic heating plate is composed of a plate body 1 and a plate component 2. The plate component comprises a plate 2.1, a resistance wire 2.2 and a connecting lead 2.3.

The plate has notches 2.1-1 formed on its circumference. A temperature controller mounting groove 2.1-2 and a connecting lead wiring groove 2.1-3 are formed in the peripheral flange of the plate.

The plate body at least comprises a plate shell 1.1, a temperature controller 1.2, a glass-ceramic disc 1.3, an electric plug 1.4, an electric plug press plate 1.5, a plug adapter 1.6 and a bottom cover plate 1.7. The electric plug 1.4 is connected with the plate component 2 through the plug adapter 1.6.

The plate shell 1.1 has a flange 1.1-1 arranged on its top periphery. A glass-ceramic disc mounting surface 1.1-1.1 is arranged on the top face of the flange 1.1-1. The interior of the plate shell has an arc-shaped convex edge 1.1-2, such that the interior of the plate shell is divided into a temperature controller mounting area A and a plate mounting area B by the convex edge 1.1-2. A temperature controller mounting groove 1.1-2.1 and a connecting lead wiring groove 1.1-2.2 corresponding to the plate is formed in the convex edge 1.1-2. The size of the connecting lead wiring groove in the convex edge is larger than that of the connecting lead wiring groove in the plate flange. A temperature controller mounting boss 1.1-3 with a columnar threaded hole is arranged at the bottom of the temperature controller mounting area. The exterior of the plate shell 1.1 has an electric plug mounting boss 1.1-4 is arranged at the bottom, and an arc-shaped electric plug positioning groove 1.1-4.1 and a rectangular plug adapter mounting hole 1.1-4.2 are formed in the mounting boss 1.1-4. The electric plug positioning groove 1.1-4.1 is communicated with the plug adapter mounting hole 1.1-4.2, and the plug adapter mounting hole 1.1-4.2 is communicated with the temperature controller mounting area A. The temperature controller mounting boss is placed in the plug adapter mounting hole, and the bottom 1.1-3.1 of the temperature controller mounting boss restricts the plug adapter. Threaded holes 1.1-4.3, 1.1-4.4 for mounting the electric plug press plate and the bottom cover plate are further formed in the plug mounting boss 1.1-4, and a plurality of ventilating and cooling holes 1.1-5 are formed in the periphery of the plug mounting boss 1.1-4.

A temperature control range of the temperature controller 1.2 is 245° C.-395° C.

In order to guarantee the mounting and positioning of the plug-in electric ceramic heating plate on the electric stove, if the electric stove is provided with a mounting and positioning ring, a mounting and positioning groove 1.1-6 is formed in the circumference of the outer surface of the plate shell, and the groove goes through to the bottom surface 1.1-1.3 of the top flange; and if the electric stove is not provided with the mounting and positioning ring, a plurality of mounting and positioning ribs 1.1-7 are arranged on the circumference of the outer surface of the plate shell.

In order to guarantee the adhesion quality and the appearance effect of the glass-ceramic disc at the top of the plate shell 1.1, an annular groove 1.1-1.2 is arranged in the glass-ceramic disc mounting surface 1.1-1.1 at the top flange of the plate shell; or an annular convex edge 1.1-1.4 is arranged on the outer ring of the glass-ceramic disc mounting surface.

The aforementioned plate shell is made of an aluminum alloy by die-casting molding, and the plate is made of a refractory, thermal-insulation and insulating composite material by compression molding.

The connecting lead on the plate component includes a lead for connecting the temperature controller and a lead for connecting the plug adapter. The diameter of the lead for connecting the plug adapter should be kept to 1.0-2.0 mm. The connection with the resistance wire and the connection with the temperature controller are achieved by welding structures. The connecting lead introduced to the end of the plug adapter is positioned to be corresponding to a plug adapter hole, and perpendicular to the end face of the plug adapter into which the connecting lead is inserted.

The temperature controller component is fixed on the temperature controller mounting boss of the plate shell through a screw. The electric plug is communicated with the connecting lead of the plate component through the plug adapter, and the electric plug is fixed to the plug adapter by screws via the plug press plate and the bottom cover plate. The glass-ceramic disc is fixed on the top face of the plate shell by means of bonding.

The electric stove of the present invention is composed of a plug-in electric ceramic heating plate and an electric stove body, and an electric socket adapted to the electric plug of the plug-in infrared heating plate should be arranged on the electric stove body.

The aforementioned application only exemplifies a typical structure of the present invention. Although other applications of the present invention involving all modifications and changes that fall within the spirit of the invention are not provided, they are intended to be covered by the appended claims.

What is claimed is:

1. An apparatus, comprising:

a plate component comprising a plate, resistance wires and connecting leads, and a plate body comprising a plate shell, a temperature controller, a glass-ceramic disc, an electric plug, an electric plug pressing board, a plug adapter and a bottom cover;

wherein the plate has a notch on a circumference of the plate, and a first temperature controller mounting groove and a first connecting lead wiring groove;

wherein the electric plug is connected with the plate component through the plug adapter;

wherein the plate shell has a flange on a periphery of the plate shell and with a mounting surface on top of the flange;

wherein an interior of the plate shell has a convex edge corresponding to a shape of the notch;

wherein the interior of the plate shell is divided into a temperature controller mounting area and a plate mounting area by the convex edge;

wherein the convex edge comprises a second temperature controller mounting groove and a second connecting lead wiring groove;

wherein a temperature controller mounting boss with a threaded hole is in the temperature controller mounting area;

wherein an exterior of the plate shell has an electric plug mounting boss with an electric plug positioning groove and a plug adapter mounting hole;

wherein the electric plug positioning groove is communicated with the plug adapter mounting hole;

wherein the plug adapter mounting hole is communicated with the temperature controller mounting area;

wherein a shape of the plug adapter mounting hole matches a shape of the plug adapter;

wherein the electric plug mounting boss comprises threaded holes for mounting the electric plug pressing board and the bottom cover; and wherein the electric plug mounting boss comprises a plurality of ventilating and cooling holes at a periphery of the electric plug mounting boss.

2. The apparatus according to claim 1, wherein a temperature control range of the temperature controller is 245° C.-395° C.

3. The apparatus according to claim 1, wherein the temperature controller mounting boss is columnar, the temperature controller mounting boss is in the plug adapter mounting hole, a bottom of the temperature controller mounting boss limits the plug adapter, the plug adapter mounting hole is a rectangular hole, the electric plug positioning groove is an arc-shaped groove, and the second connecting lead wiring groove is larger than the first connecting lead wiring groove.

4. The apparatus according to claim 3, wherein a mounting and positioning groove is in a circumference of an outer surface of the plate shell, and the mounting and positioning groove extends through the flange; or wherein a plurality of mounting and positioning ribs are on the circumference of the outer surface of the plate shell.

5. The apparatus according to claim 4, wherein an annular slot is in the mounting surface; or wherein an annular convex edge is on an outer ring of the mounting surface.

6. The apparatus according to claim 4, wherein the plate shell is made of an aluminum alloy by die-casting molding, and the plate is made of a refractory, thermal-insulation and insulating composite material by compression molding.

7. The apparatus according to claim 6, wherein the connecting leads of the plate component comprise a first lead for connecting the temperature controller and a second lead for connecting the plug adapter, the second lead having a diameter within a range of 1.0-2.0 mm.

8. An electric stove comprising an electric stove body and the apparatus of claim 1, and at least an electric socket on the electric stove body and matched with the electric plug.

9. The apparatus according to claim 1, wherein the notch is arc-shaped.

* * * * *